US007823405B2

(12) United States Patent
Williams

(10) Patent No.: US 7,823,405 B2
(45) Date of Patent: Nov. 2, 2010

(54) ROTATING BERNOULLI HEAT PUMP

(76) Inventor: Arthur R. Williams, 42 Wyndhurst Dr., Holden, MA (US) 01520

( * ) Notice: Subject to any disclaimer, the term of this patent is extended or adjusted under 35 U.S.C. 154(b) by 727 days.

(21) Appl. No.: 11/817,794

(22) PCT Filed: Jun. 17, 2005

(86) PCT No.: PCT/US2005/021462

§ 371 (c)(1),
(2), (4) Date: Sep. 5, 2007

(87) PCT Pub. No.: WO2006/009844

PCT Pub. Date: Jan. 26, 2006

(65) Prior Publication Data

US 2009/0145155 A1 Jun. 11, 2009

Related U.S. Application Data

(60) Provisional application No. 60/580,790, filed on Jun. 18, 2004.

(51) Int. Cl.
*F25B 27/00* (2006.01)

(52) U.S. Cl. ..... 62/324.1; 62/401

(58) Field of Classification Search ..... 62/86, 62/324.1, 324.2, 401, 419, 467; 165/86, 165/122, 185
See application file for complete search history.

(56) References Cited

U.S. PATENT DOCUMENTS 2,223,429 A 12/1940 Smith et al.
2,544,299 A 3/1951 Damon et al.
2,857,332 A 10/1958 Tenney et al.
2,979,921 A * 4/1961 Sampietro ..... 62/499
3,010,799 A 11/1961 Ecal
3,049,891 A 8/1962 Barkelew (Continued)

FOREIGN PATENT DOCUMENTS

DE 698598 11/1940

(Continued)

OTHER PUBLICATIONS

Backhaus et al. "A thermoacoustic Stirling heat engine" Nature (May 27, 1999), vol. 399, pp. 335-338.

(Continued)

*Primary Examiner*—Mohammad M Ali
(74) *Attorney, Agent, or Firm*—Goodwin Procter LLP

(57) ABSTRACT

Heat engines move heat from a source to a sink. In a subset of heat engines, called heat pumps, the temperature of the source is below that of the sink. A subset of heat pumps, called working-fluid heat pumps, accomplishes the heat-pumping function by varying the temperature of a working fluid over a range that includes the temperatures of both the source and the sink. A subset of working fluid heat pumps, called Bernoulli heat pumps, accomplish this temperature variation of the working fluid by means of Bernoulli conversion of random molecular motion into directed motion (flow). This invention is a Bernoulli heat pump in which Bernoulli conversion is accomplished using a rotating disk, similar to those used in computers for data storage. Most working fluid heat pumps used for cooling and heating accomplish the temperature variation by compression of the working fluid. In contrast to compression, Bernoulli conversion consumes no energy.

13 Claims, 10 Drawing Sheets

U.S. PATENT DOCUMENTS

| | | | | | |
|---|---|---|---|---|---|
| 3,200,607 | A | | 8/1965 | Williams | |
| 3,334,026 | A | | 8/1967 | Bobell | |
| 3,344,051 | A | | 9/1967 | Latham | |
| 3,347,059 | A | * | 10/1967 | Laing | 62/325 |
| 3,688,770 | A | | 9/1972 | O'Neill | |
| 3,808,828 | A | | 5/1974 | Kantor | |
| 3,981,627 | A | | 9/1976 | Kantor | |
| 3,989,101 | A | | 11/1976 | Manfredi | |
| 4,378,681 | A | | 4/1983 | Modisette | |
| 4,726,198 | A | * | 2/1988 | Ouwenga | 62/499 |
| 5,275,006 | A | | 1/1994 | McCutchen | |
| 5,315,844 | A | * | 5/1994 | Hansen | 62/325 |
| 5,335,143 | A | | 8/1994 | Maling, Jr. et al. | |
| 5,412,950 | A | | 5/1995 | Hu | |
| 5,901,568 | A | * | 5/1999 | Haga | 62/324.6 |
| 6,050,326 | A | | 4/2000 | Evans et al. | |
| 6,089,026 | A | | 7/2000 | Hu | |
| 6,175,495 | B1 | | 1/2001 | Batchelder | |
| 6,635,154 | B2 | | 10/2003 | Johnson et al. | |
| 6,651,358 | B2 | | 11/2003 | Giacobbe | |
| 6,659,169 | B1 | | 12/2003 | Lopatinsky et al. | |
| 6,684,822 | B1 | | 2/2004 | Lieggi | |
| 6,702,545 | B2 | * | 3/2004 | Scholten | 415/1 |
| 7,273,091 | B2 | * | 9/2007 | Bahl et al. | 165/121 |
| 2003/0206796 | A1 | | 11/2003 | Scholten | |

FOREIGN PATENT DOCUMENTS

| | | |
|---|---|---|
| DE | 4103655 | 8/1992 |
| JP | 3-124917 | 5/1991 |

OTHER PUBLICATIONS

Tijani et al. "Prandtl Number and thermoacoustic refrigerators" J. Acoust. Soc. Am. (Jul. 2002) 112, pp. 134-143.

International Preliminary Report on Patentability for PCT/IB2006/002176 issued on Feb. 12, 2008.

International Preliminary Report on Patentability for PCT/US2005/021462 issued on Dec. 20, 2006.

International Preliminary Report on Patentability for PCT/US2006/008428 issued on Sep. 12, 2007.

International Preliminary Report on Patentability for PCT/US2006/024633 issued on Dec. 24, 2007.

International Search Report for PCT/IB2006/002176, mailed on Jan. 30, 2007.

International Search Report for PCT/US2005/21462, mailed on Apr. 7, 2006.

International Search Report for PCT/US2006/08428, mailed on Oct. 24, 2006.

International Search Report for PCT/US2006/24633, mailed on Jan. 17, 2007.

* cited by examiner 4
6
5
7

8

6
16
11
9
4
15
5
10

1
2
4
18
5
10

2
3
3
3
3
3
3
18
4
12
18

ROTATING BERNOULLI HEAT PUMP

CROSS REFERENCE TO RELATED APPLICATIONS

This application claims priority to Provisional U.S. Patent application No. 60/580,790

BACKGROUND OF THE INVENTION

1. Field of the Invention

The present invention relates to heat pumps, devices that move heat from a heat source to a warmer heat sink. More specifically, it relates to Bernoulli heat pumps.

2. Discussion of Related Art

Heat engines are devices that move heat from a heat source to a heat sink. Heat engines can be divided into two fundamental classes distinguished by the direction in which heat is moved. Heat spontaneously flows "downhill", that is, to lower temperatures. As with the flow of water, such "downhill" heat flow can be harnessed to produce mechanical work, as illustrated by internal-combustion engines, e.g. Devices that move heat "uphill", that is, toward higher temperatures, are called heat pumps. Heat pumps necessarily consume power. Refrigerators and air conditioners are examples of heat pumps. Most commonly used heat pumps employ a working fluid whose temperature is varied over a range that includes the temperatures of both the source and sink between which heat is pumped. This temperature variation is commonly accomplished by compression of the working fluid. Bernoulli heat pumps effect the required temperature variation by converting random molecular motion (temperature and pressure) into directed motion (macroscopic fluid flow). A fluid spontaneously converts random molecular motion into directed motion when the cross sectional area of a flow is reduced to form a Venturi. Temperature and pressure reflect random molecular motion and are reduced when a flow is nozzled, an effect called the Bernoulli principle. Whereas compression consumes power, Bernoulli conversion does not.

The Bernoulli effect is well known, best known perhaps, as the basis for aerodynamic lift. Three earlier U.S. patents (U.S. Pat. Nos. 3,049,891, 3,200,607 and 4,378,681) describe devices designed to exploit Bernoulli conversion for the purpose of pumping heat. All three use stationary, solid-walled nozzles to effect the required variation of the cross-sectional area of a fluid flow.

BRIEF SUMMARY OF THE INVENTION

The present invention uses a rotating disk to create a Bernoulli heat pump. A heat pump transfers heat from a relatively cool heat source to a relatively warm heat sink. In the present invention, both the heat source and the heat sink are fluid flows. The heat transfer takes place through an intermediary, a rotating disk that is a good thermal conductor that is in good thermal contact with both flows. In the present invention, the fundamental heat-pump action, that is, the transfer of heat from the cooler source to the warmer sink, occurs because rotation of the disk causes the temperature of the portion of the sink flow that is in thermal contact with the rotating disk to be cooled to a temperature below that of the source flow. This cooling of the portion of the sink flow that is in thermal contact with the spinning disk is accomplished by exploitation of Bernoulli's principle. Rotation of the disk creates an hour-glass-shaped flow pattern or Venturi. In the neck of the Venturi, Bernoulli conversion has converted random molecular motion into directed flow, such that the temperature and pressure are depressed, while the flow speed is elevated. The depressed temperature in the Venturi neck allows heat to flow spontaneously from the rotating disk into the sink flow.

According to another aspect of the invention, the flow may be created in liquids. The flow may also be created in gases. According to another aspect of the invention, flow in the neck of the Venturi may be axial relative to the rotation of the disk. According to another aspect of the invention, flow in the neck of the Venturi may be circumferential relative to the rotation of the disk. According to another aspect of the invention, flow in the neck of the Venturi may be radial relative to the rotation of the disk. According to another aspect of the invention, multiple Venturis are formed by the rotating disk that merge to form toroidal circulations. According to another aspect of the invention, multiple disks are rotated coaxially to create multiple Venturis for greater cooling capacity. According to another aspect of the invention, multiple disks are rotated coaxially to create multiple Venturis in order to pump heat across a greater temperature difference. According to another aspect of the invention, non-rotating housings are used to segregate flows within the heat pump.

BRIEF DESCRIPTION OF THE REFERENCE NUMBERS

1. The slow, wide and hot portion of the heat-sink Venturi in which the fluid is approaching the neck of the Venturi.

2. The fast, narrow and cold neck of the heat-sink Venturi.

3. The slow, wide and hot portion of the heat-sink Venturi that carries the heat transferred from the disk to the Venturi neck.

4. The rotating disk.

5. The axis of rotation of the disk.

Figures 2A, 2B:
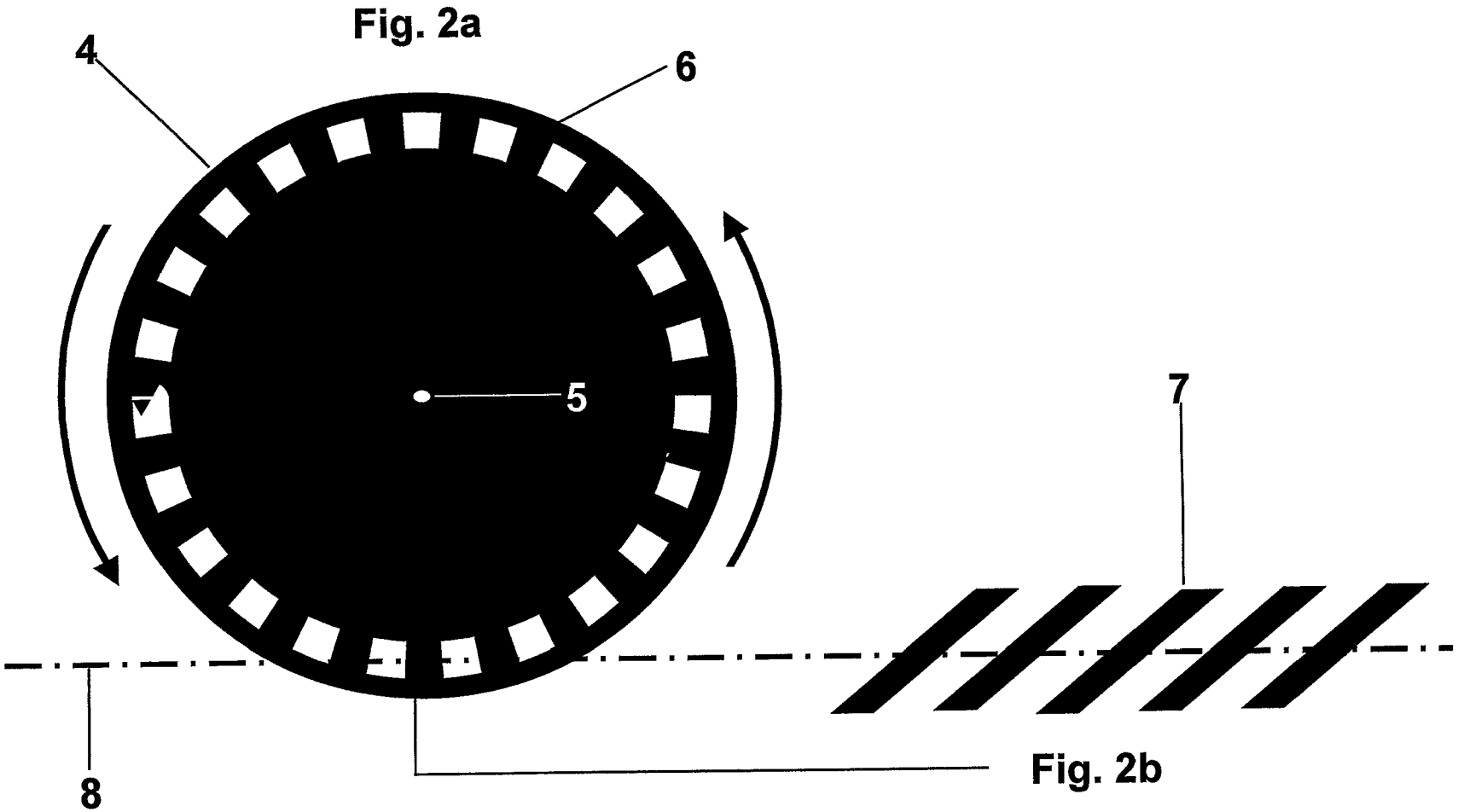
FIG. 2 shows top (FIG. 2*a*) and side (FIG. 2*b*) views of an annular turbine.

6. Annular turbine (See FIG. 2.)

7. Turbine blades mounted in annular portion of rotating disk.

8. Plane viewed in FIG. 2*b*.

9. Heat-source flow. In this embodiment, the heat source is a fluid flowing axially inside a hub to which the disk is attached.

10. Portion of stator that segregates the heat-sink flow from other parts of the system.

11. Portion of the stator to which heat is transferred out of the heat-sink flow. It is here that region 3 of the heat-sink flow is converted back to region 1 of the flow:

12. Optional hub. Disks can be mounted on the exterior of the hub; turbines, fins, etc. can be mounted on the interior of the hub.

13. Small-radius turbine maintains the flow of the heat-source fluid along the axis of rotation.

14. The toroidal flow produced by opposed annular turbines, that is, two Venturis each comprising regions 1, 2 and 3 merge to form a single toroidal circulation, which is referred to collectively by the single label 14.

15. Heat flow in disk.

16. Heat flow in stator.

17. Circulating coolant as part of heat sink.

18 Thermal insulation. This allows successive stages of the heat pump to pump between successively lower temperatures.

DETAILED DESCRIPTION OF THE INVENTION

In embodiments of the invention, a rotating disk 4 creates a heat pump by maintaining within the heat-sink fluid flow an hour-glass-shaped Venturi 1-2-3, into which heat flows spontaneously as a result of the depressed temperature in the neck 2 of the Venturi. Heat flows within the disk 15, and enters the heat-sink Venturi at its low-temperature neck 2. Fluid flow in the neck 2 of the heat-sink Venturi is characterized by a direction. Three classes of embodiments are distinguished by this flow direction in the Venturi neck 2, relative to the rotation axis of the rotating disk. Flow in the Venturi neck 2 can be axial (FIGS. 1-6), radial (FIGS. 7 and 8) or circumferential (FIGS. 9 and 10), corresponding respectively to the three cylindrical coordinates, z, r and theta, appropriate to the description of rotating systems. In the figures describing fluid flows by fields of arrows, the length of the arrow represents the local speed of the flow in the direction of the arrow.

Figure 1:
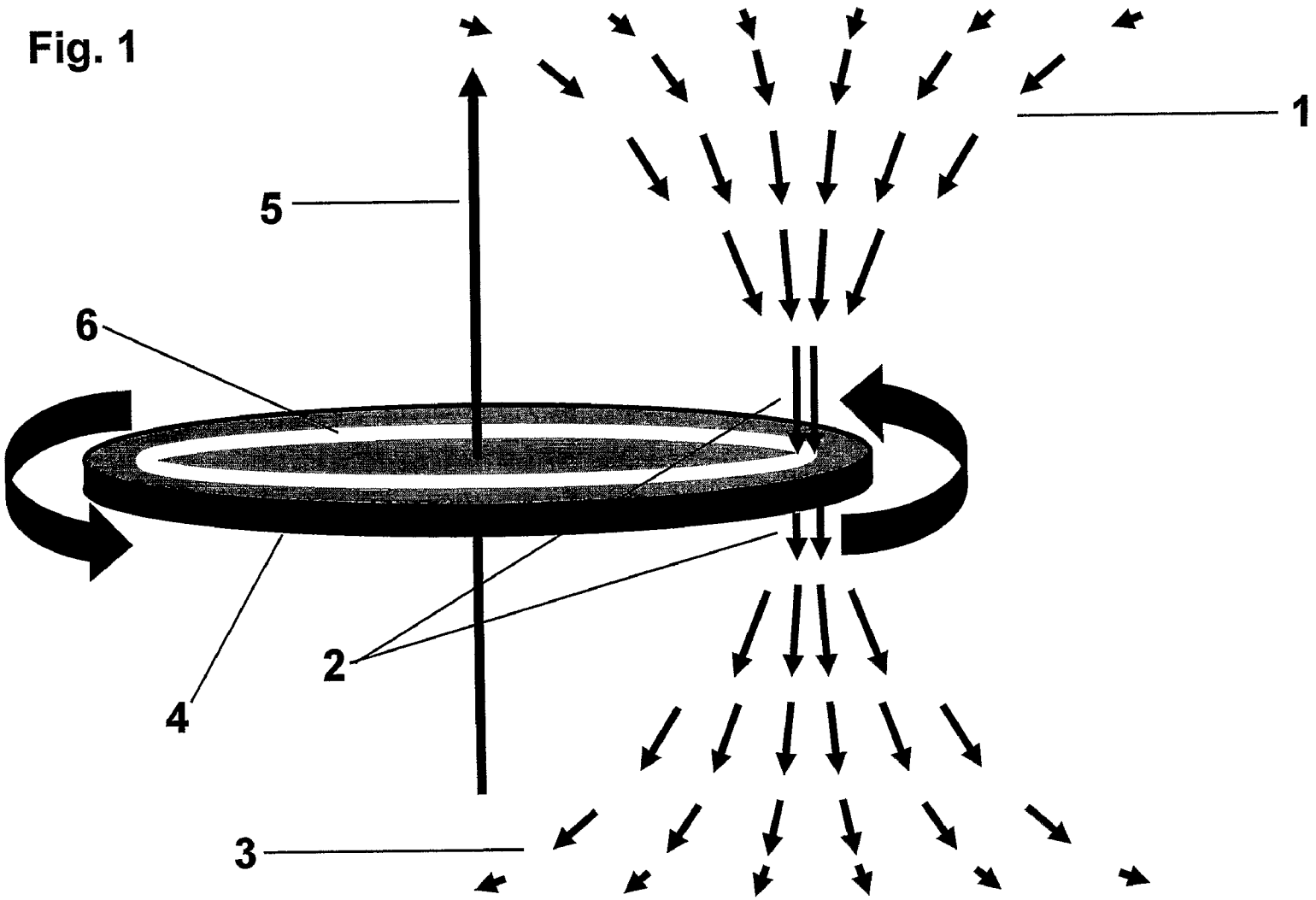
FIG. 1 shows the hour-glass-shaped heat-sink Venturi maintained by a spinning disk containing an annular turbine.
Figure 3:
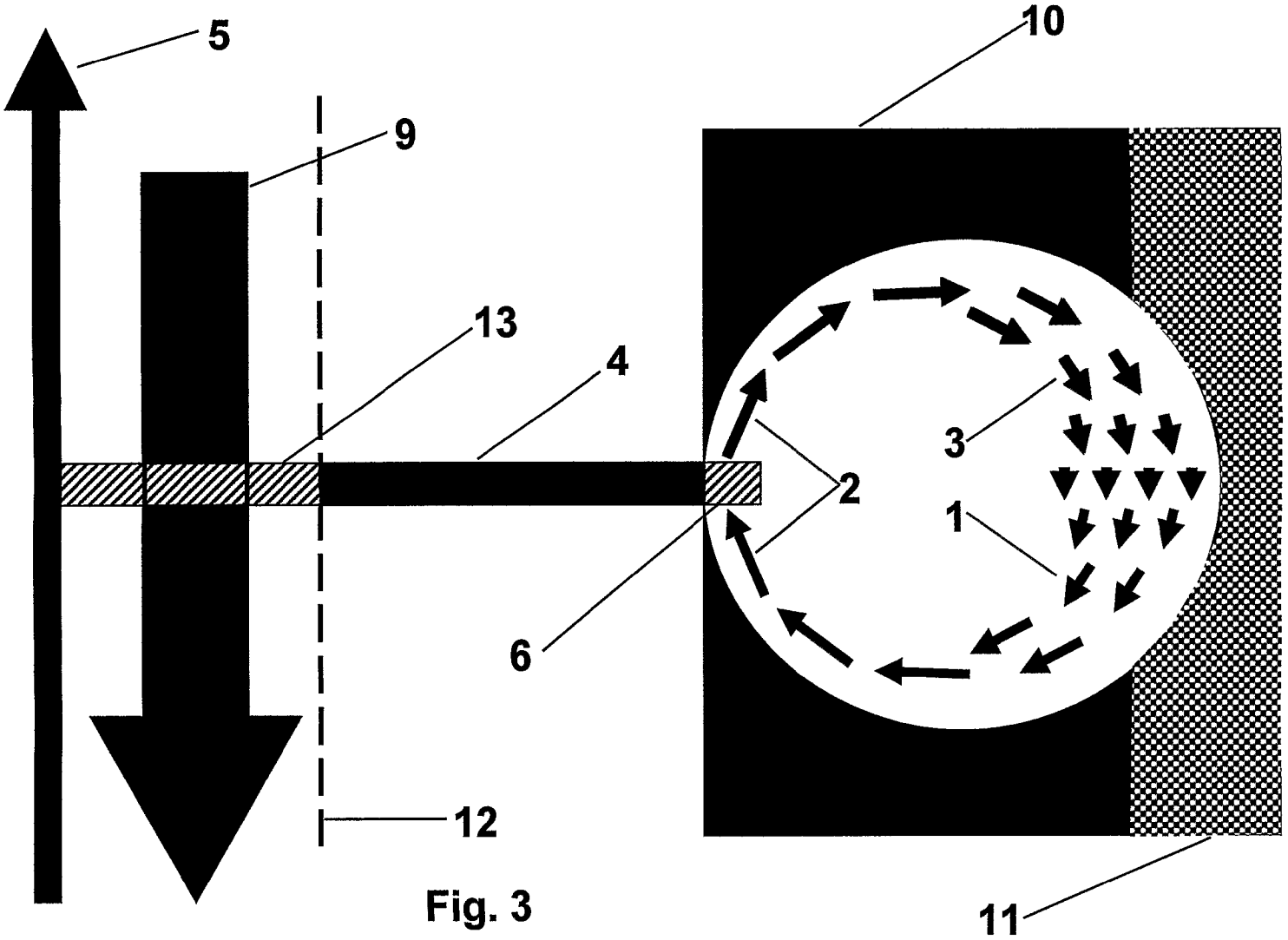
FIG. 3 illustrates a closed axial system employing small-radius and large-radius turbines, as well as a stator and a hub.

Consider first embodiments in which the Venturi-neck flow 2 is axial, that is, parallel to the rotation axis of the rotating disk. FIGS. 1 and 3 show axial Venturi-neck flows 2 produced by a single annular turbine 6. FIG. 2 shows the annular turbine in greater detail. Note, in particular, that the orientation of the turbine blades 7 determines the direction of the Venturi-neck 2 flow, that is, up versus down, in FIG. 1. The surface area available for heat transfer into the Venturi neck is controlled by the area of the turbine blades 7, that is, by the thickness of the disk 4, the radius of the turbine 6 and by the spacing of the turbine blades 7. FIG. 3 shows that wide portions of the Venturi away from the neck can be deformed. In FIG. 3, a single Venturi is deformed into a toroidal circulation. FIG. 3 also illustrates two additional embodiment options: 1) the segregation of the sink flows by a stator 11, and 3) the removal of heat from the heat-sink Venturi by a stator 12. A stator 11-12, is a non-rotating structure or surface near the rotating disk. Note that removal of heat by the stator converts region 3 of the Venturi into region 1.

Figure 4:
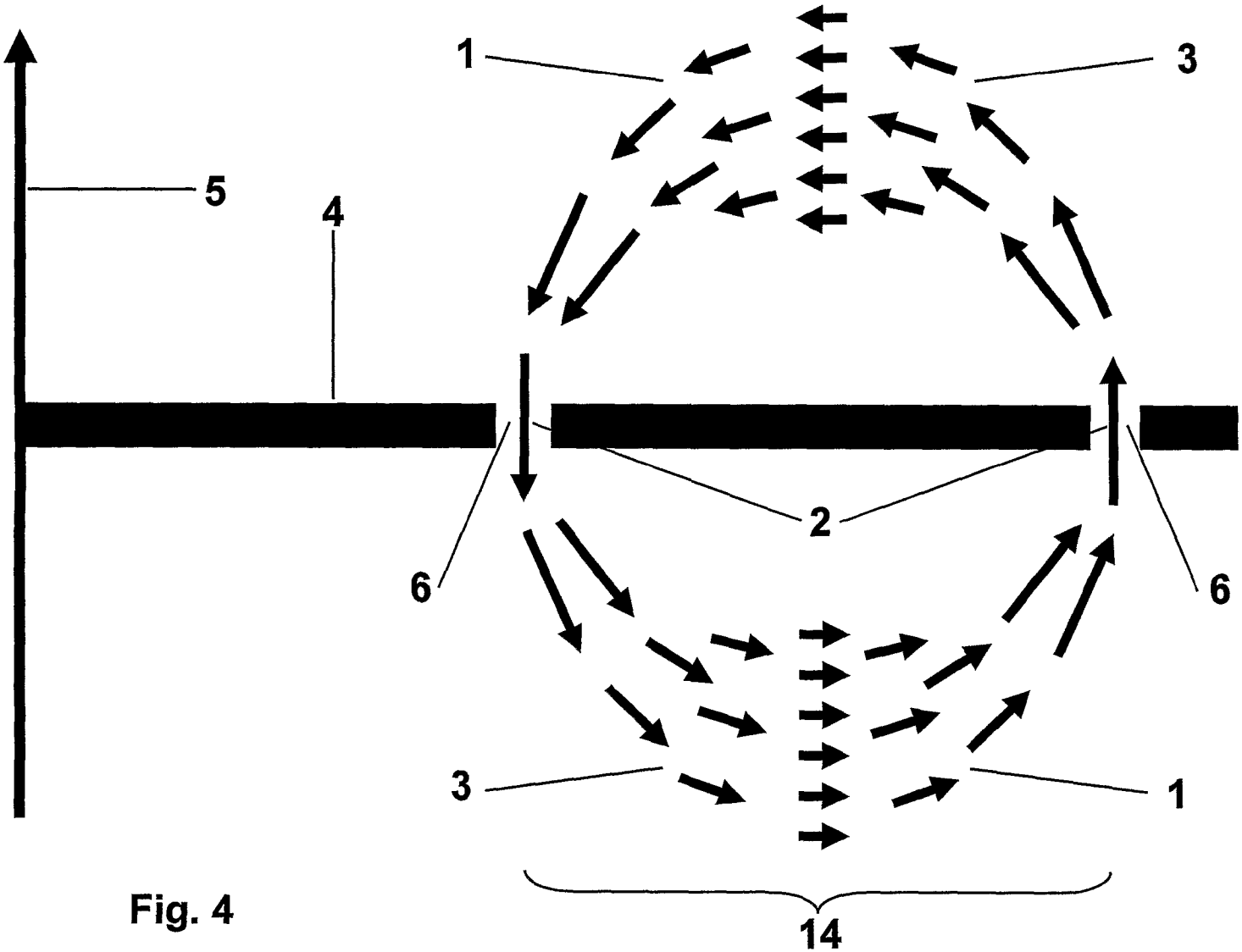
FIG. 4 shows how opposed annular turbines produce opposed Venturis, which merge to form a nozzled toroidal circulation.
Figures 5A, 5B:
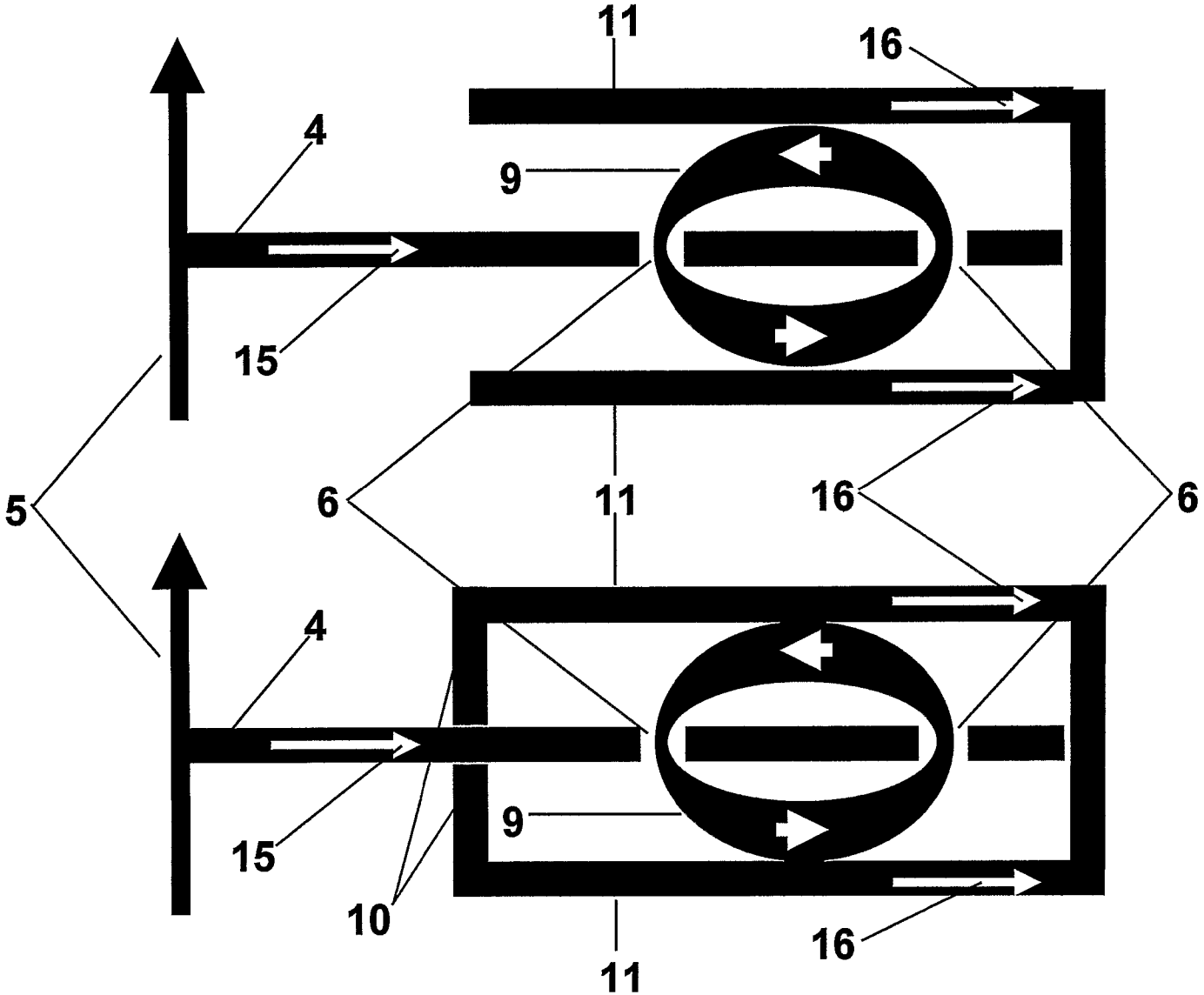
FIG. 5 compares open (FIG. 5*a*) and closed (FIG. 5*b*) toroidal-flow systems.
Figure 6:
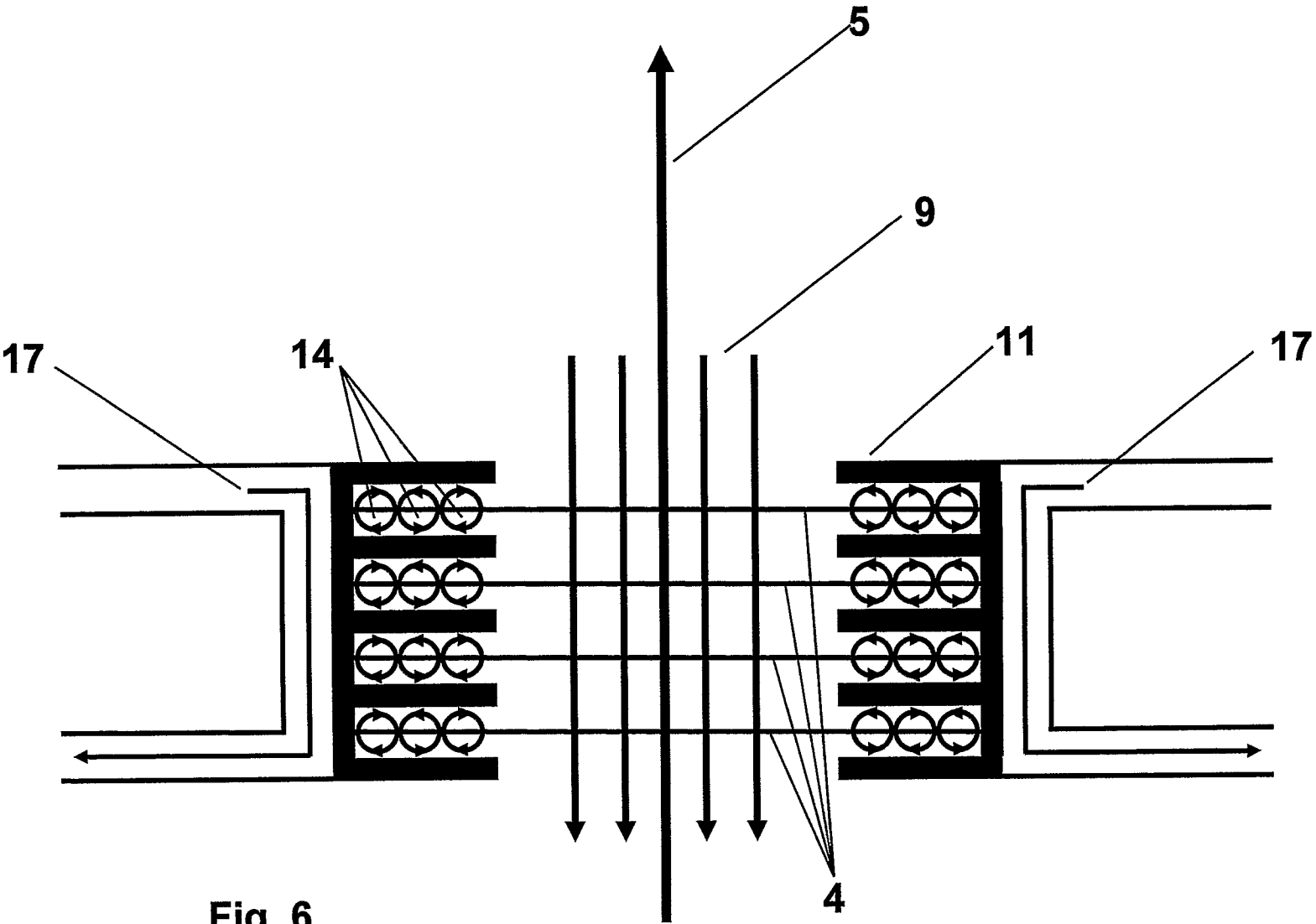
FIG. 6 shows a staged, multi-torus axial Bernoulli heat pump.

An embodiment option that represents an elaboration of the idea of axial flows shown in FIGS. 1 and 3, is that of opposed axial flows and their merger to form nozzled, toroidal circulations 14. FIGS. 4, 5 and 6 illustrate opposed annular turbines and the nozzled toroidal flows they produce.

Figures 8A, 8B:
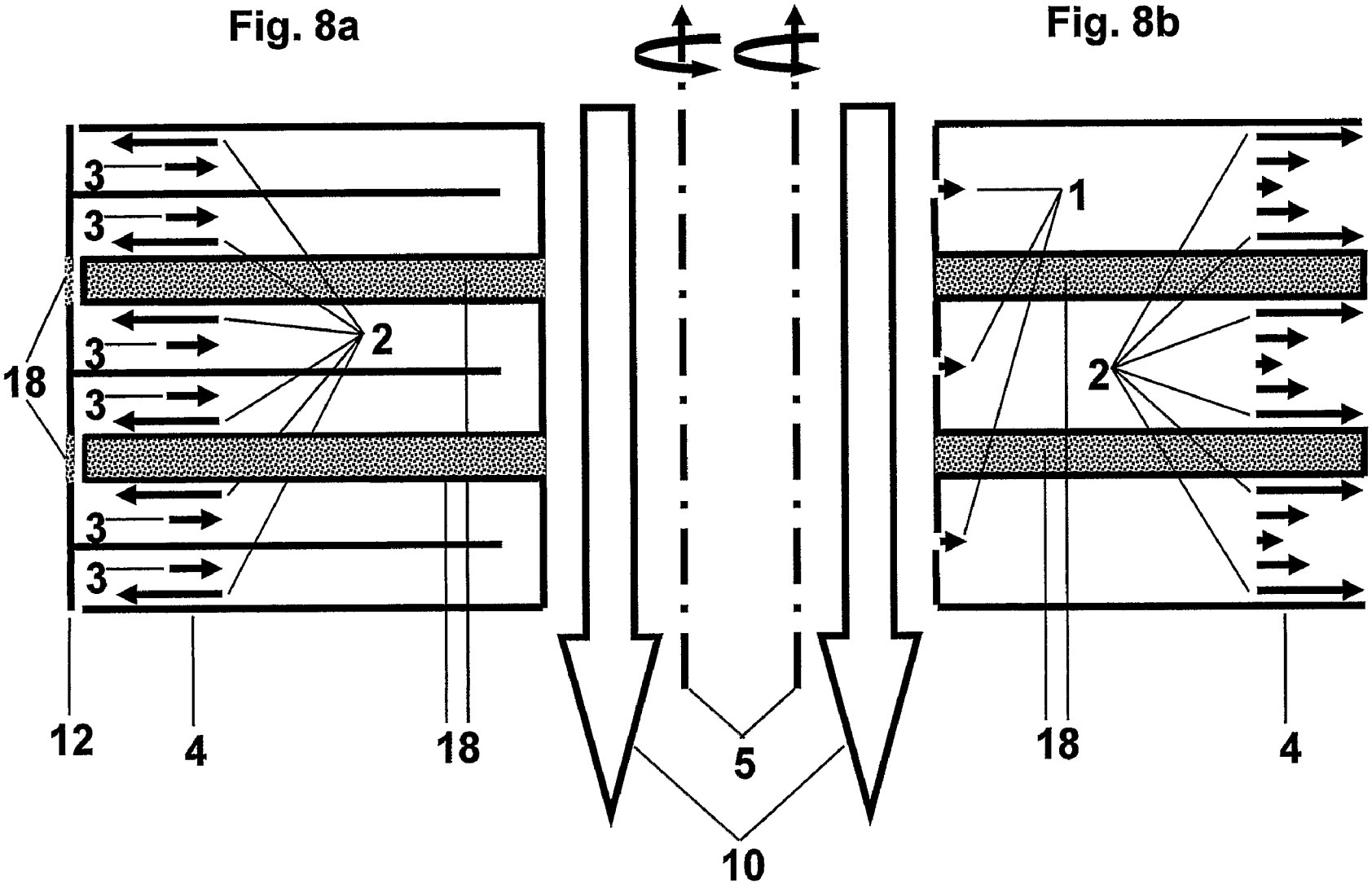
FIG. 8 compares open (FIG. 8*a*) and closed (FIG. 8*b*) Ekman-flow systems.

FIGS. 3, 6 and 8 illustrate a possible configuration of the heat-source fluid flow 9 near and parallel to the disk rotation axis 5. The heat-source flow can also be a gas or a liquid. FIG. 3 illustrates the guidance (and segregation for closed systems) of the heat-source flow by a thermally conductive hub 12 to which the disk(s) 4 is/are attached. Heat transfer from the heat-source flow to the hub can be enhanced by fins, turbine blades 13, etc. inside the hub 12.

FIG. 6 combines several of the embodiment options considered above with an additional embodiment option, the use of multiple disks corotating about a common rotation axis for the purpose of increasing the pumping capacity of the heat pump. In addition to multiple coaxial disks, FIG. 6 shows multiple toroidal circulations 14, the use of stators 11, a heat-source flow 9 sustained by a small-radius turbine 13 as well as a coolant 17 that removes heat from the stator. FIG. 6 thus represents a complex embodiment.

FIG. 6 also illustrates the four-way utilization of the rotating disk. We exploit both the fact that the turbine blade speed is proportional to the radius of the turbine, and the fact that the temperature of the Bernoulli-cooling effect is proportional to the square of the flow speed. As illustrated in FIG. 3, a small-radius (low speed) turbine 13, 1) maintains a flow of the heat-source flow, while 2) transferring heat from the heat-source flow into the thermally conducting disk. Large-radius (high-speed) turbines 6 are used to 3) maintain the toroidal Venturi circulation 14 and its temperature variation, while 4) simultaneously allowing heat to flow from the large-radius turbine blades 6 into the relatively cold neck 2 of the heat-sink Venturi.

Figure 7:
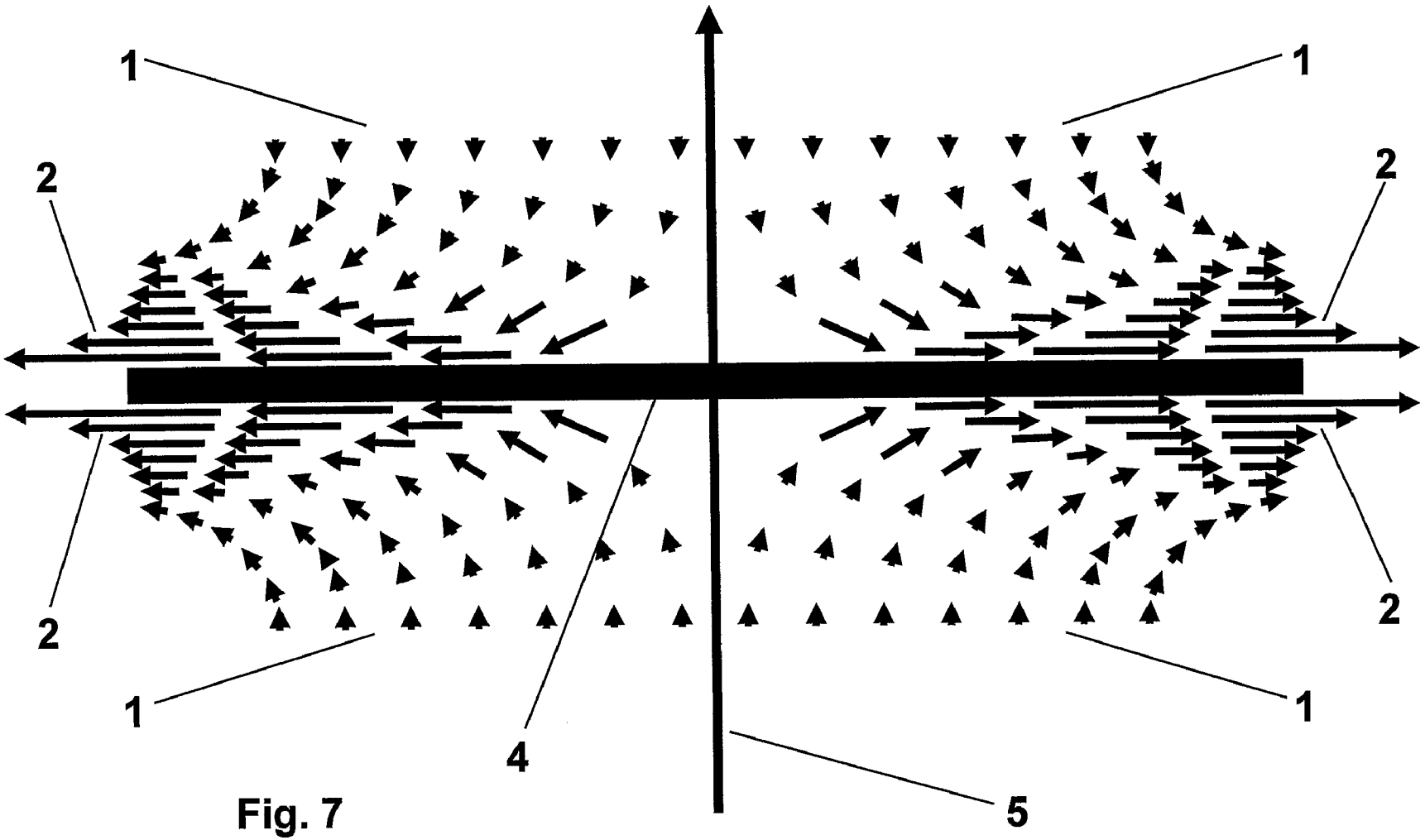
FIG. 7 shows fluid flow near the surface of a spinning disk (Ekman flow).

Consider now embodiments in which the in the Venturi neck is radial. Radial flow in the Venturi neck is illustrated in FIGS. 7 and 8. In the case of radial flow, the hour-glass shape of the Venturi is quite distorted. Nonetheless, the Ekman flow shown in FIGS. 7 and 8 exhibits the characteristics of a Venturi that are required by a Bernoulli heat pump. As we move along the flow, the cross-sectional area of the flow descends through a minimum and reexpands. The temperature and pressure are depressed near the surface of the rotating disk where the flow speed is elevated, that is, just as in FIG. 1 where the traditional hour-glass shape is more clearly discerned.

FIG. 8 compares open and closed embodiments of a Bernoulli heat pump based on radial flow. Both the open and closed embodiments exploit Ekman flows near multiple coaxially rotating disks, and both embodiments exploit stators. In contrast to FIG. 6, however, the embodiments shown in FIG. 8 use multiple coaxially rotating disk for the purpose of increasing the temperature difference across which heat is pumped. For this reason, individual rotating disks are thermally insulated 18 from one another.

Figure 9:
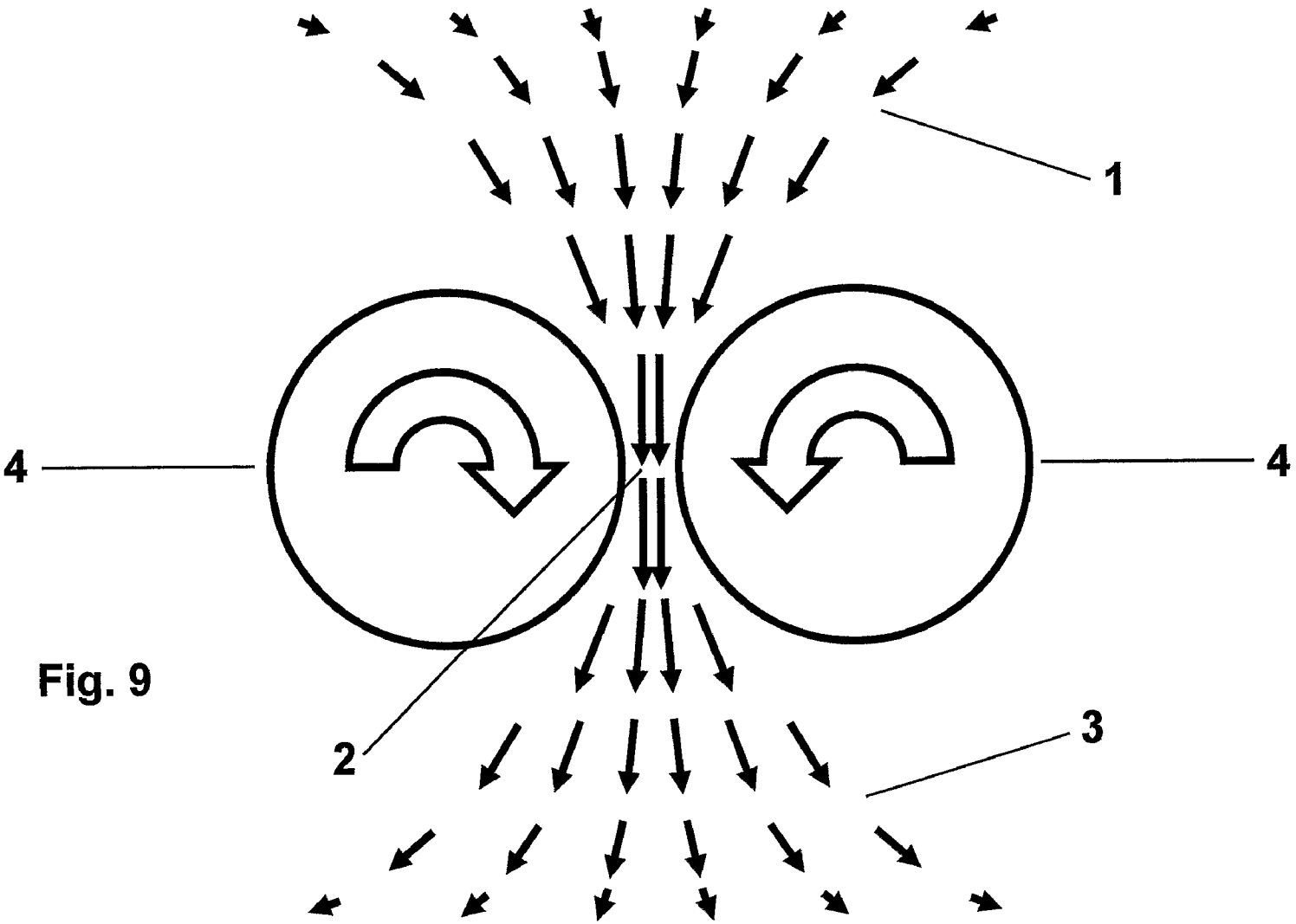
FIG. 9 illustrates a circumferential heat-sink Venturi.
Figure 10:
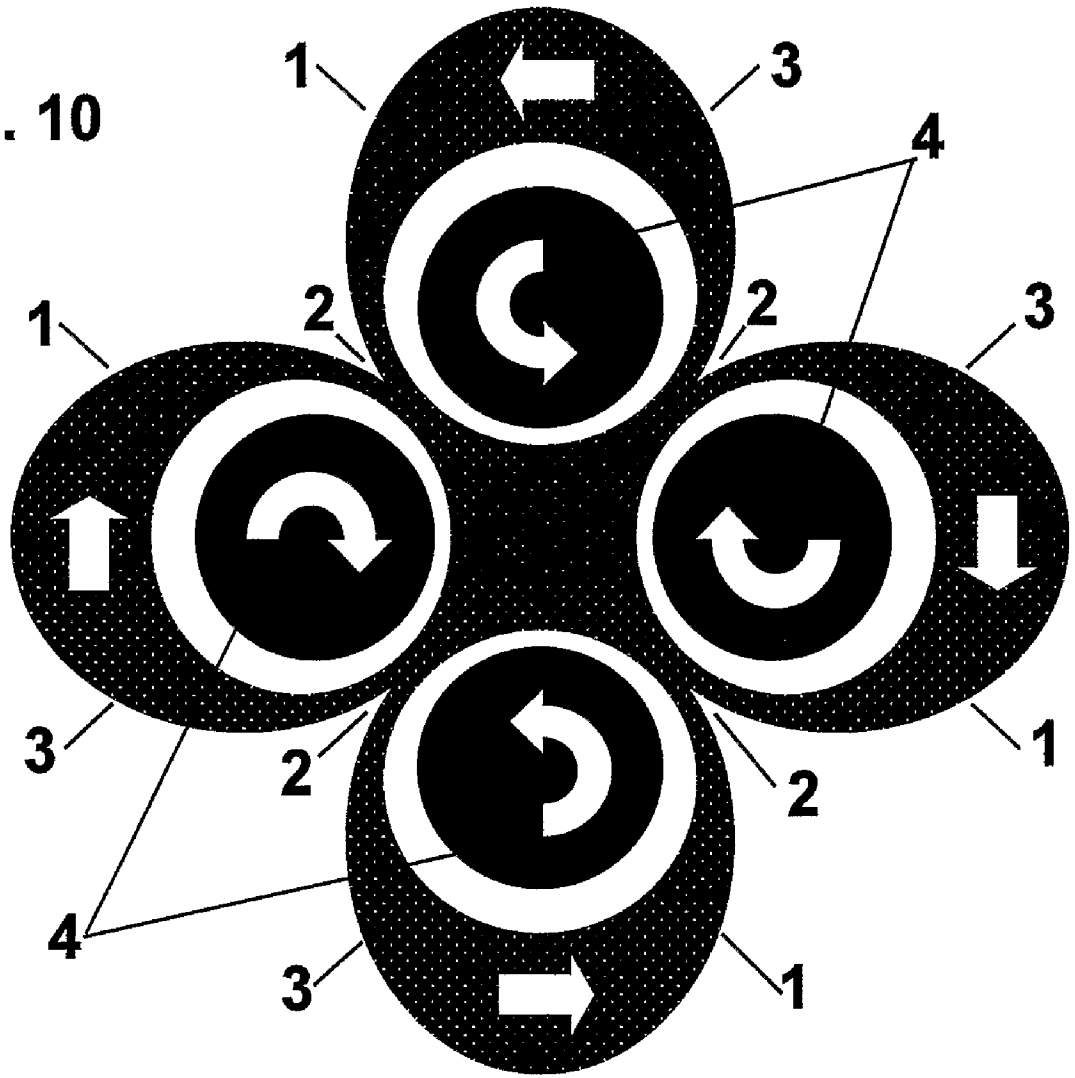
FIG. 10 shows a complex circumferential heat-sink Venturi.

Consider finally embodiments in which the Venturi-neck flow 2 is circumferential. Circumferential flow in the Venturi neck is illustrated in FIGS. 9 and 10. In these embodiments, the "disk" is thick, and can be thought of as a cylinder or roller. Such embodiments differ in one important respect from embodiments characterized by axial and radial flows. With radial and axial flows, the surface of the disk that is in thermal contact with the Venturi does not move in the direction of the Venturi-neck flow 2. The result is that the velocity in the fluid exhibits a boundary layer across which the fluid velocity varies from that of the disk surface to that of the Venturi neck 2. In the case of circumferential flow in the Venturi neck 2, the outer surface of the rotating disk moves in the direction of the Venturi-neck flow 2, thus reducing the importance of the velocity boundary layer. For embodiments based on circumferential flow, the heat-source fluid can flow inside the rotating disk, along its rotation axis. The heat transferred to the heat-sink flow is transferred to a stationary, thermally conducting enclosure (not shown in FIGS. 9 and 10) for closed embodiments. For open embodiments fluid enters from the environment and returns to the environment at a higher temperature.

A final embodiment option is the purpose for which the heat pump is intended and used. As emphasized by U.S. Pat. No. 3,200,607, heat pumps can be used to heat or to cool. The present invention can be used for either purpose.

A challenge endemic to Bernoulli heat pumps is the transfer of heat into the neck 2 of the Venturi. To enter the cold portion of the heat-sink flow, the heat must, in most configurations, traverse a boundary layer, in which the working fluid is neither rapidly moving nor cold. Fortunately, heat flux is driven, not by the temperature, but by its gradient, which can be favorable, even in the boundary layer. Both this invention and the invention described in U.S. Pat. No. 3,200,607 employ large surface areas for this transfer. As discussed above, the circumferential flows shown in FIGS. 9 and 10 differ from the other possibilities in this regard. The circumferential flow patterns imply less relative motion of the fluid and the disk.

The invention claimed is:

1. A heat pump comprising a rotatable, thermally-conducting disk arranged to sustain an hour-glass-shaped heat-sink fluid flow near the periphery of said disk, such that heat spontaneously transfers from said disk to the neck portion of said hour-glass-shaped fluid flow, a heat-source fluid flow in good thermal contact with the portion of said disk away from the periphery of said disk, and a drive mechanism that rotates said disk.

2. A heat pump as in claim 1 wherein the fluid comprising the hour-glass-shaped heat-sink fluid flow includes a gas.

3. A heat pump as in claim 1 wherein the fluid comprising the hour-glass-shaped heat-sink fluid flow includes a liquid.

4. A heat pump as in claim 1 wherein the fluid comprising said heat-source fluid flow includes a gas.

5. A heat pump as in claim 1 wherein the fluid comprising said heat-source fluid flow includes a liquid.

6. A heat pump as in claim 1 wherein the direction of fluid flow in said neck region of said heat-sink fluid flow is radial, relative to the rotation axis of said disk.

7. A heat pump as in claim 1 wherein the direction of fluid flow in said neck region of said heat-sink fluid flow is circumferential, relative to the rotation axis of said disk.

8. A heat pump as in claim 1 wherein the direction of fluid flow in said neck region of said heat-sink fluid flow is axial, relative to the rotation axis of said disk.

9. A heat pump as in claim 8 wherein said axial heat-sink fluid flow is toroidal, passing through the plane of said disk at least twice.

10. A heat pump as in claim 1 wherein multiple disks increase the heat-pumping capacity of said heat pump.

11. A heat pump as in claim 1 wherein multiple disks increase the temperature range over which heat is pumped.

12. A heat pump as in claim 1 comprising a stationary housing that segregates said heat-sink fluid flow.

13. A heat pump as in claim 1 comprising a rotatable hub that segregates said heat-source fluid flow.

* * * * *